United States Patent [19]

Spinner

[11] 3,936,116

[45] Feb. 3, 1976

[54] COAXIAL HF MULTIPLE ROTARY CONNECTION

[76] Inventor: Georg Spinner, ErzgieBereistr. 33, 8 Munich 2, Germany

[22] Filed: June 12, 1974

[21] Appl. No.: 478,527

[30] Foreign Application Priority Data

June 15, 1973 Germany ..... 2330585

[52] U.S. Cl. ..... 339/8 R; 339/177 R; 339/200 R

[51] Int. Cl.[2] ..... H01R 39/00

[58] Field of Search ..... 339/8 R, 8 P, 6 R, 200 R, 339/200 P, 177 R, 177 E, 182 RS

[56] References Cited

UNITED STATES PATENTS

| | | | |
|---|---|---|---|
| 2,700,137 | 1/1955 | Ragan | 339/8 P |
| 3,408,610 | 10/1968 | Clarkson | 339/8 R |

*Primary Examiner*—Roy Lake
*Assistant Examiner*—DeWalden W. Jones
*Attorney, Agent, or Firm*—Ostrolenk, Faber, Gerb & Soffen

[57] ABSTRACT

The disclosure concerns a coaxial h-f multiple rotary connection, in particular for rotating antennas of radar equipment, comprising galvanic rotary contacts. In the rotary coupling of the hollow inner conductors of an outer coaxial system the rotary coupling of an inner coaxial system forming for said outer system only a reactance is disposed and the outer conductors of the inner coaxial system led radially out of the outer coaxial system are connected to the outer conductors of the outer coaxial system. This reactance can be compensated by suitable dimensioning, ensuring reflexion-free passage of the outer line.

5 Claims, 2 Drawing Figures

COAXIAL HF MULTIPLE ROTARY CONNECTION

The invention relates to a coaxial h-f multiple rotary connection, in particular for rotating antennas of radar equipment, comprising galvanic rotary contacts.

Known constructions usually permit the centrally disposed coaxial line to be equipped for example with galvanic rotary contacts and thus to transmit a frequency range of 0 c/s up to the limit frequency of the line. The coaxial connections placed externally round this line can however only transmit a limited frequency range because the supply line to the outer transmission channels must take place via frequency-dependent means.

The problem underlying the invention is to provide a rotary coupling in which the frequency range of 0 up to the limit frequency of the corresponding line can be transmitted via two or more line systems disposed within each other.

According to the invention this problem is solved in that in the rotary coupling of the hollow inner conductors of an outer coaxial system the rotary coupling of an inner coaxial system forming for said outer system only a reactance is disposed and that the outer conductors of the inner coaxial system led radially out of the outer coaxial system are connected to the outer conductors of the outer coaxial system.

This reactance can be compensated by suitable dimensioning, ensuring reflexion-free passage of the outer line.

Disturbance by possible contact wear can be prevented by corresponding overlapping dielectric of the individual line systems.

The construction according to the invention permits the transmission in the inner coaxial system of frequencies of 0 c/s up to the limit frequency of the line and in the outer coaxial system of a frequency range of 0 c/s up to the resonant frequency of the short-circuited line section consisting of the loop in the outer conductor of the outer system. The inner line represents for the outer system only a capacitive load and reduces th characteristic impedance and by suitable dimensioning of the line components of the outer system this may be compensated up to a maximum frequency by means known per se.

Figure 1:
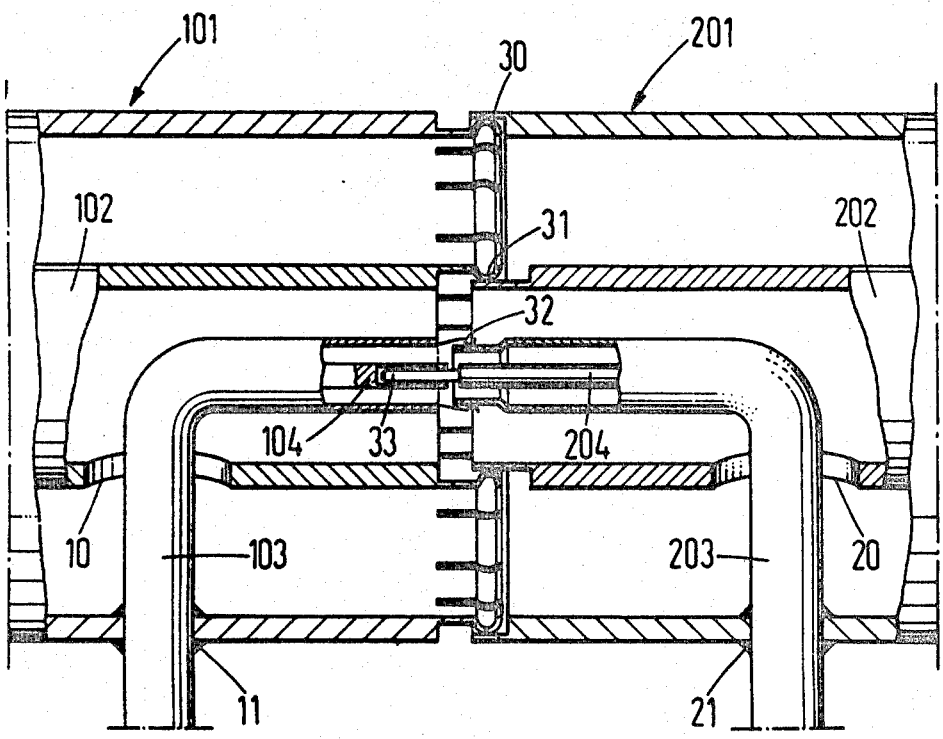
Figure 2:
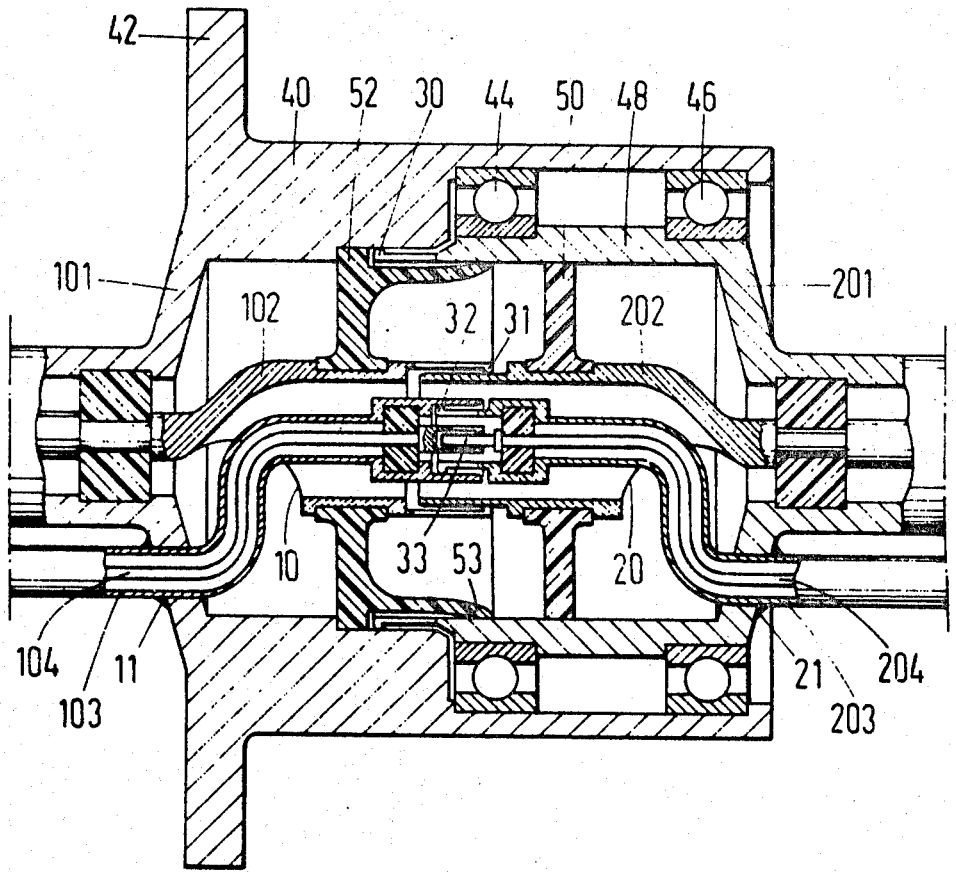

Examples of embodiment of the invention will be described with the aid of the drawings, wherein:

FIG. 1 is a schematic illustration of a rotary coupling according to the invention comprising two coaxial systems one within the other, showing the principle of the transmission function, FIG. 2 is a practical embodiment of a twin rotary coupling made according to the invention.

An inner coaxial line consisting of outer conductor 103 or 203 and inner conductor 104 or 204 with outer conductor rotary coupling 32 and inner conductor rotary coupling 33 is disposed in the center axis of the rotary system and is enclosed concentrically by the inner conductor 102 or 202 of the second coaxial system whose outer conductors are denoted by 101 and 201. The outer conductor rotary coupling 30 and the inner conductor rotary coupling 31 represent a galvanic contact of the outer conductors and inner conductors of the outer system.

The inner coaxial conductors are led freely through passages 10 and 20 of the inner conductor 102 and 202 of the outer system and extend further through bores in the outer conductor 101 and 201 and the outer conductor 103, 203 of the inner system is connected electrically to said outer conductor 101, 201 at 11 and 21 respectively.

In the practical example of embodiment according to FIG. 2 parts corresponding to parts in FIG. 1 are provided with the same reference numerals. The outer conductor 101 of the outer coaxial system is led via a conical transition to a drum 40 which comprises a mounting flange 42 and supports via ball bearings 44, 46 a hub 48 rotatable therein and forming part of the outer conductor 201 of the outer system. The inner conductor 202 of the outer system is supported with respect to the hub 48 via an insulating support disc 50 whereas the inner conductor 102 is supported by means of an insulating support 52 within the drum 40.

The hole provided for passage of the inner coaxial system in the conical transition is so dimensioned and arranged that it ensures the necessary compensation of the characteristic impedance. According to the example of embodiment illustrated the inner coaxial line welded into the conical transition 101 extends parallel to the outer coaxial line, both in the left portion and in the right portion.

As apparent, the structure is such that assembly is effected easily by pushing the two parts of the rotary coupling into each other. The insulating support 52 is extended according to FIG. 2 to the right to form a sleeve extension 53 which bears against the inner wall of the hub 48 in the form of a lip seal.

What I claim is:

1. A rotary assembly of HF coaxial cables, with a portion of one of the cables being inside the other of the cables, comprising;

an internal coaxial cable having a first internal conductor and a first external conductor outside said first internal conductor; said internal cable having a first portion of a first length and said first portion being inside an external coaxial cable;

an external coaxial cable having a hollow second internal conductor; said second internal conductor having a second portion of at least said first length and said second portion having a cross section greater than the cross section of said first external conductor; said external cable having a second external conductor outside said second internal conductor;

said internal cable first portion being located inside said second internal conductor second portion; beyond both ends of its said first portion, said internal cable passing from within said second internal conductor through both said second internal and external conductors to without said external cable, whereby said internal cable serves as a reactance in said external cable; said first external conductor being electrically connected to said second external conductor at both locations along said internal cable where said internal cable passes through said second external conductor;

said internal cable first portion being separated into two sections, first rotary coupling means separably joining both of said internal cable first and second conductors in said internal cable first portion;

said external cable second portion being separated into two sections, second rotary coupling means separably joining both of said external cable second internal and external conductors in said external cable second portion.

2. The rotary assembly of HF coaxial cables of claim 1, wherein the dimensions and cross sections of both said second conductors at said second portion are different than for the remainder of said external cable and the dimensions and cross sections of said second conductors at said second portion are selected to insure reflexion free passage of said outer cable.

3. The rotary assembly of HF coaxial cables of claim 1, wherein both said internal and said external cable respective first and second rotary coupling means comprise rotary plug means, which permit respective conductors to be plugged together and separated, while permitting relative rotation of one plugged conductor section with respect to the cooperating plugged conductor section when all of said internal and external cable conductor sections are plugged together.

4. The rotary assembly of HF coaxial cables of claim 3, wherein one said section of said second external conductor comprises a drum having a relatively greater internal diameter and the other said section of said second conductor comprises a hub having a relatively lesser external diameter; said drum at least partly overlapping said hub; rotary bearing means interposed between the overlapped said drum and said hub to support and enable relative rotation of these said second external conductor sections.

5. The rotary assembly of HF coaxial cables of claim 4, further comprising an insulative support supporting said external cable second internal and external conductors apart and extending between said second internal conductor and one of said plugged sections of said second external conductor;

said insulative support having a lip that extends past the said plug means of said second external conductor and that bears sealingly yet relatively rotatably against the other said section of said second external conductor.

* * * * *